US011460193B2

(12) United States Patent
Gayakwad et al.

(10) Patent No.: US 11,460,193 B2
(45) Date of Patent: Oct. 4, 2022

(54) LEVELING ASSEMBLY

(71) Applicant: WHIRLPOOL CORPORATION, Benton Harbor, MI (US)

(72) Inventors: Sachin R. Gayakwad, Maharashtra (IN); Sidhaiyasamy Kaliappan, Tamil Nadu (IN); Devendra Bhaskar Shirore, Maharashtra (IN); Pradeep Shankar Thorat, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 391 days.

(21) Appl. No.: 16/817,938

(22) Filed: Mar. 13, 2020

(65) Prior Publication Data

US 2021/0285652 A1 Sep. 16, 2021

(51) Int. Cl.
*F24C 7/08* (2006.01)
*F24C 15/08* (2006.01)

(52) U.S. Cl.
CPC ..... *F24C 7/082* (2013.01); *F24C 15/086* (2013.01)

(58) Field of Classification Search
CPC ..... F24C 7/082; F24C 7/083; F24C 15/08; F24C 15/022; F24C 15/083; F24C 3/126
See application file for complete search history.

(56) References Cited

U.S. PATENT DOCUMENTS

| | | | | |
|---|---|---|---|---|
| 3,509,605 | A | 5/1970 | More | |
| 4,004,570 | A | 1/1977 | Keeling, Sr. | |
| 4,250,865 | A | 2/1981 | Scherer | |
| 6,079,169 | A | 6/2000 | Ashworth | |
| 9,863,642 | B2 | 1/2018 | Je et al. | |
| 10,208,963 | B2 | 2/2019 | Lee et al. | |
| 2003/0010886 | A1* | 1/2003 | Barnes | F24C 15/083 248/500 |
| 2016/0334113 | A1* | 11/2016 | Lee | F24C 15/08 |
| 2021/0190325 | A1* | 6/2021 | Funk | F24C 15/086 |

FOREIGN PATENT DOCUMENTS

| | | | |
|---|---|---|---|
| DE | 19649047 | C2 | 9/1998 |
| DE | 19845260 | C1 | 3/2000 |
| EP | 3040622 | B1 | 11/2017 |
| EP | 2558784 | B1 | 6/2018 |
| WO | 2013182428 | A1 | 12/2013 |
| WO | 2018001497 | A1 | 1/2018 |

* cited by examiner

*Primary Examiner* — Monica C King
(74) *Attorney, Agent, or Firm* — Price Heneveld LLP

(57) ABSTRACT

A leveling assembly for a user interface includes a bracket housing that defines an aperture. A carrier is disposed within the bracket housing. The carrier defines an opening proximate to the aperture defined by the bracket housing. An engagement feature is coupled to the carrier and extends through the opening and the aperture. A leveler is operably coupled to the carrier and is configured to translate the carrier between a first position and a second position relative to the aperture defined by the bracket housing.

20 Claims, 11 Drawing Sheets

LEVELING ASSEMBLY

BACKGROUND OF THE DISCLOSURE

The present disclosure generally relates to an appliance, and more specifically, to a leveling assembly for an appliance.

SUMMARY OF THE DISCLOSURE

According to one aspect of the present disclosure, an appliance includes a frame that defines a channel, and a user interface operably coupled to the frame. The user interface has a console and a front panel. At least one leveling assembly is coupled to the console and is configured to adjust a gap defined between the front panel of the user interface and the frame. The at least one leveling assembly includes a bracket housing that has a first portion that defines an aperture and a second portion that extends orthogonally to the first portion. A leveler has a shaft and a knob that is coupled to the shaft. The leveler extends through a second portion of the bracket housing and defines threads along a length of the shaft.

According to another aspect of the present disclosure, a leveling assembly for a user interface includes a bracket housing that defines an aperture. A tab projects from to bracket housing. The tab is configured to engage a frame of an appliance. A carrier is disposed within the bracket housing. The carrier defines an opening proximate to the aperture defined by the bracket housing. An engagement feature is coupled to the carrier and extends through the opening and the aperture. A leveler is operably coupled to the carrier and is configured to translate the carrier between a first position and a second position relative to the aperture defined by the bracket housing.

According to yet another aspect of the present disclosure, an appliance includes a frame that defines a channel and a slot. A leveling assembly is coupled to the frame and includes a bracket housing that has a tab, a first portion and a second portion normal relative to the first portion. The second portion defines a threaded aperture. A leveler has a shaft that defines threads along a length of the shaft, and a knob is coupled to the shaft. The shaft extends through the threaded aperture defined by the second portion of the bracket housing and rotatably couples the leveler to the bracket housing. A user interface has a front panel and a console that is operably coupled to the frame via the leveling assembly.

These and other features, advantages, and objects of the present disclosure will be further understood and appreciated by those skilled in the art by reference to the following specification, claims, and appended drawings.

Figure 1:
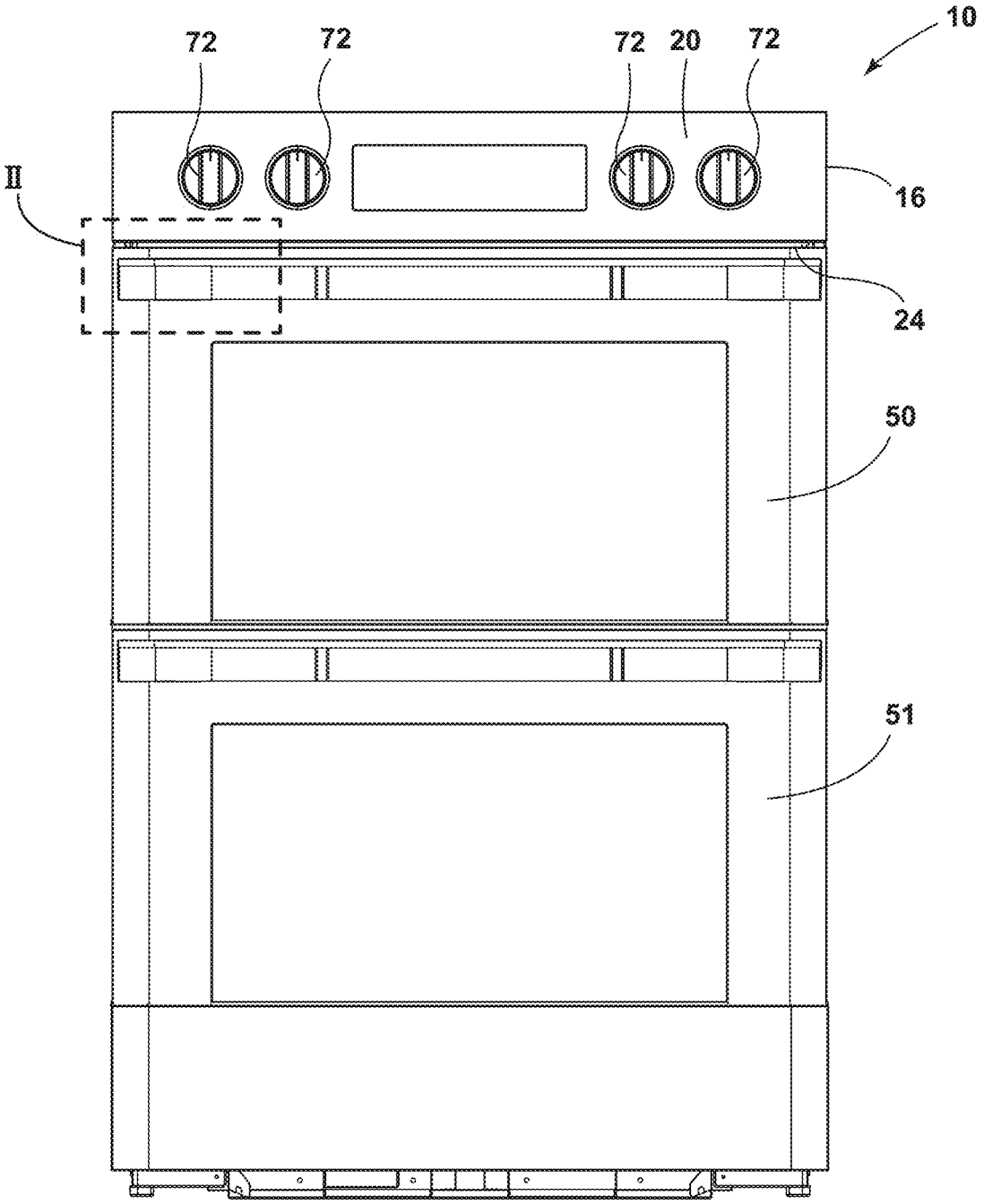
FIG. 1 is a front elevational view of an appliance of the present disclosure.

The components in the figures are not necessarily to scale, emphasis instead being placed upon illustrating the principles described herein.

DETAILED DESCRIPTION

The present illustrated embodiments reside primarily in combinations of apparatus components related to a leveling assembly. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-12, reference numeral 10 generally designates an appliance that includes a frame 12 defining a channel 14. A user interface 16 is operably coupled to the frame 12 and has a console 18 and a front panel 20. At least one leveling assembly 22 is coupled to the console 18 and is configured to adjust a gap 24 defined between the front panel 20 of the user interface 16 and the frame 12. The leveling assembly 22 includes a bracket housing 26 having a first portion 28 that defines an aperture 30. The bracket housing 26 also has a second portion 32 that is normal to the first portion 28 and is coupled to the first portion 28 via an arcuate edge 34. The at least one leveling assembly 22 also includes a leveler 36 that has a shaft 38 and a knob 40 that is coupled to the shaft 38. The leveler 36 extends through the second portion 32 of the bracket housing 26 and defines threads 42 along a length L of the shaft 38.

Figure 2:
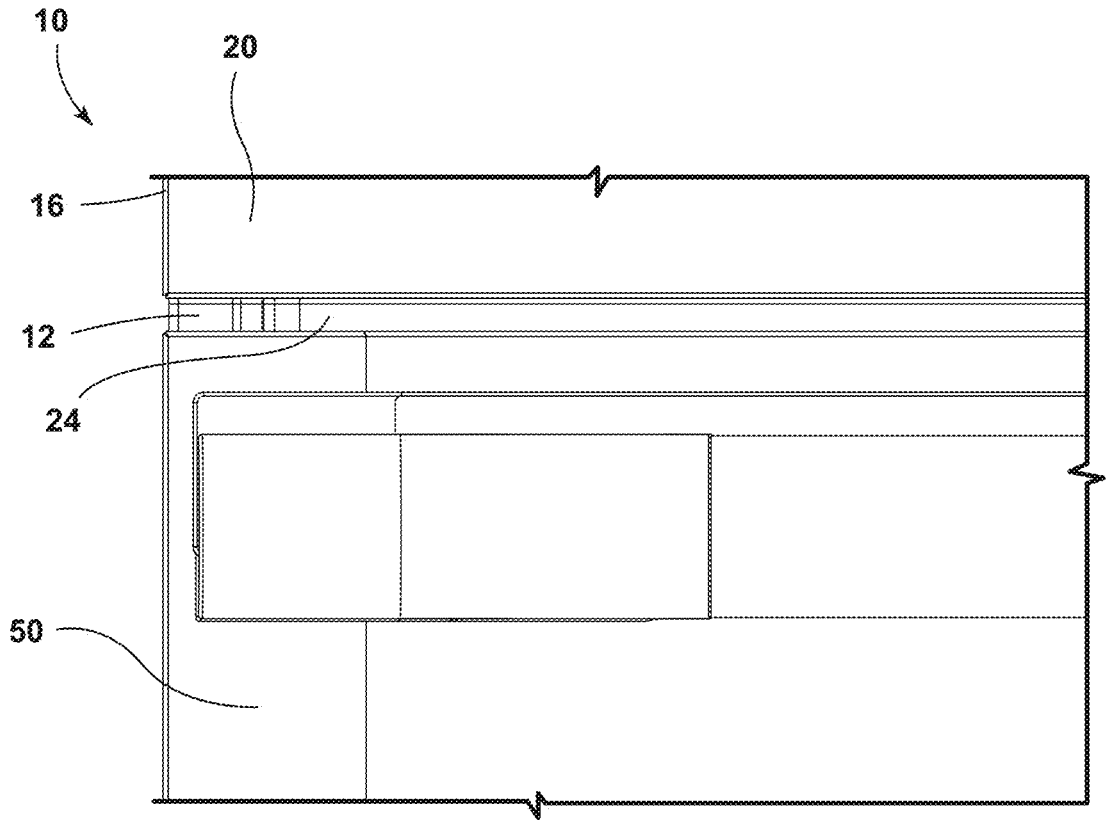
FIG. 2 is an enlarged partial front elevational view of an appliance of the present disclosure with a gap defined between a front panel and a first door.
Figure 3A:
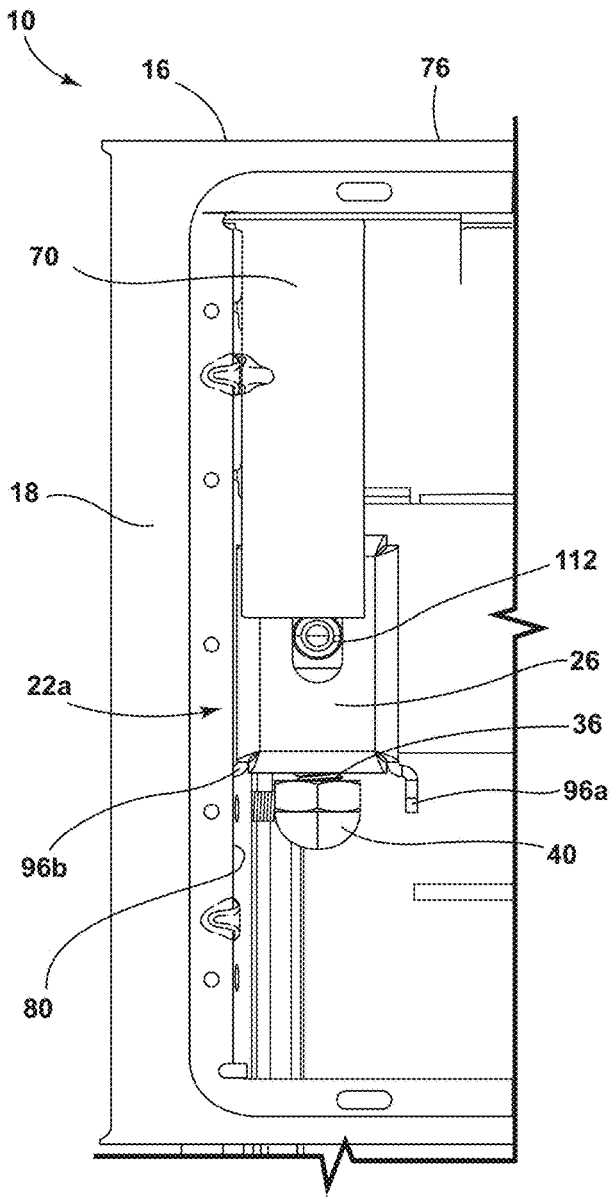
FIG. 3A is an enlarged front elevational view of a first end of a console for an appliance of the present disclosure with a first leveling assembly.
Figure 3B:
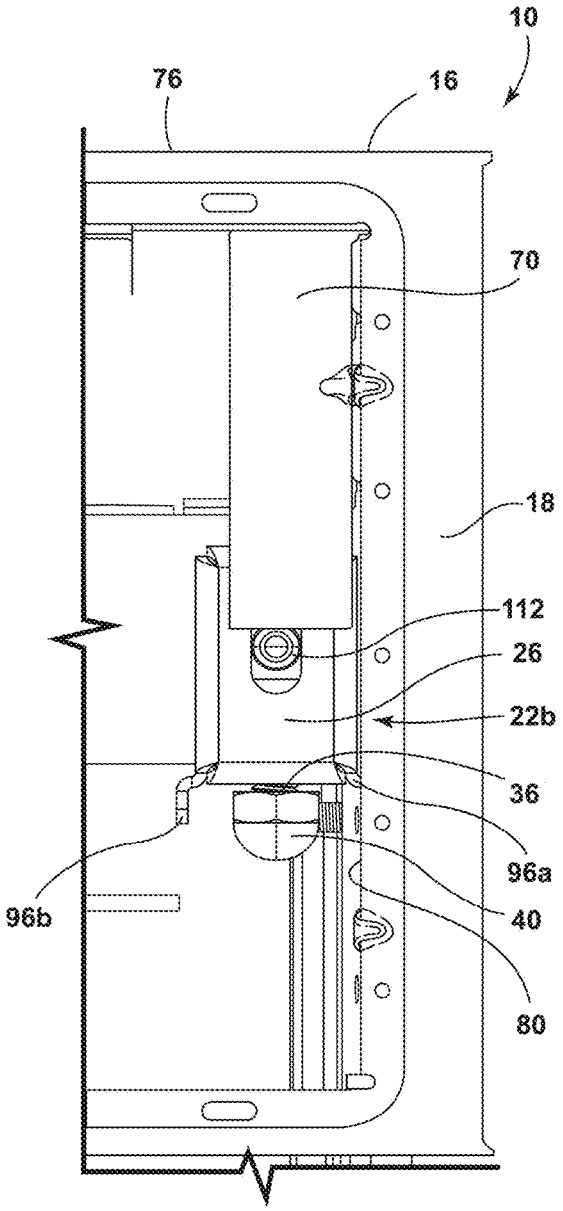
FIG. 3B is an enlarged front elevational view of a second end of the console of FIG. 3A with a second leveling assembly.

Referring to FIGS. 1-3, the appliance 10, as depicted, is in the form of an oven having the frame 12 and first and second doors 50, 51. While aspects of the present disclosure are discussed with relation to a cooking appliance, such as an oven, it is within the scope of the present disclosure that certain aspects may be utilized in a variety of home appliances, including but not limited to, a microwave oven, a refrigerator, a freezer, and other traditional home appliances. Moreover, while the appliance 10 is illustrated with first and second doors 50, 51, it is also contemplated that the appliance 10 can have a single door.

The first door 50 of the appliance 10 is positioned proximate to the front panel 20 of the user interface 16 to define the gap 24 therebetween. It is generally contemplated that the first door 50 is hingedly coupled to the frame 12 of the appliance 10 to transition the first door 50 from a closed position to an open position. When the first door 50 is in the closed position, the gap 24 is defined beneath the front panel 20 and above the first door 50. It is contemplated that the gap 24 may be five millimeters or less. As described in more detail below, the gap 24 is maintained, adjusted, and set by the leveling assembly 22, which is coupled to both the frame 12 and the console 18.

Figure 4:
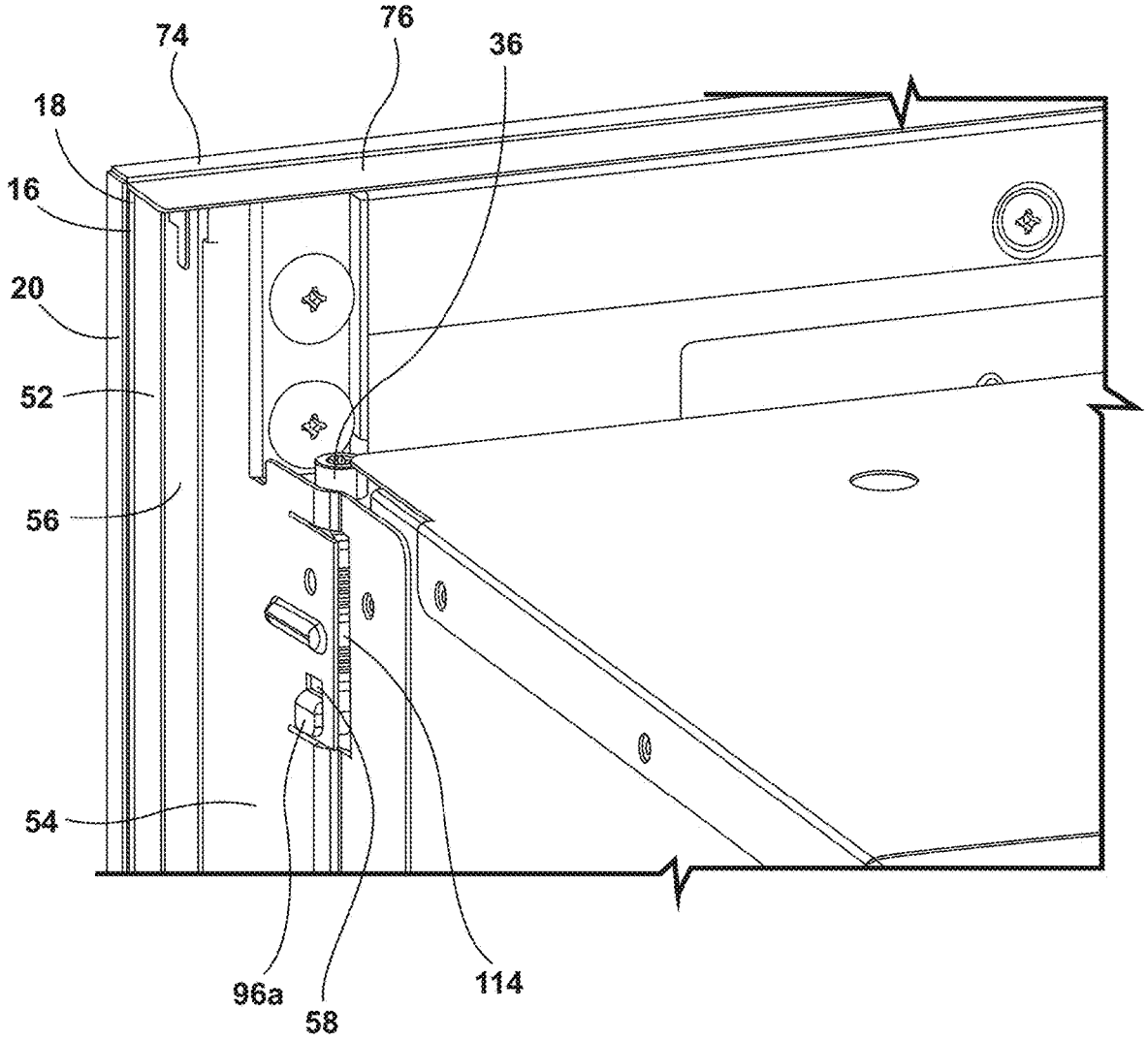
FIG. 4 is an enlarged partial rear perspective view of an appliance of the present disclosure.

As illustrated in FIG. 4, the frame 12 includes first and second sides 52, 54 coupled by a connecting wall 56 to define the channel 14 therebetween. The connecting wall 56 of the frame 12 defines a slot 58 through which the leveling assembly 22 can couple to the frame 12 of the appliance 10, as described below. Additionally or alternatively, the slot 58 may be defined by the first and second sides 52, 54 of the frame 12, such that the leveling assembly 22 may be coupled to at least one of the first or second sides 52, 54 through the slot 58, described in further detail below.

Referring now to FIGS. 2-6, the user interface 16 is positioned proximate to the frame 12 and includes the console 18, which provides the general framework for the user interface 16. The console 18 includes a flange 70 to which the leveling assembly 22 can be coupled behind the front panel 20. The front panel 20 of the user interface 16 is positioned over the console 18, such that the console 18 and the leveling assembly 22 is generally concealed by the front panel 20. Control knobs 72 are operably coupled to the front panel 20 and the console 18. The control knobs 72 are configured to operate at least temperature controls of the appliance 10. In general, the control knobs 72 at least partially retain the front panel 20 on the console 18, as the front panel 20 includes a lip 74 that is loosely disposed on a top edge 76 of the console 18. As the console 18 and the front panel 20 are generally coupled, an upward and downward adjustment of the console 18 by the leveling assembly 22 results in adjustment of the front panel 20 as well, such that the user interface 16 as a whole is adjusted by the leveling assembly 22.

Figure 5:
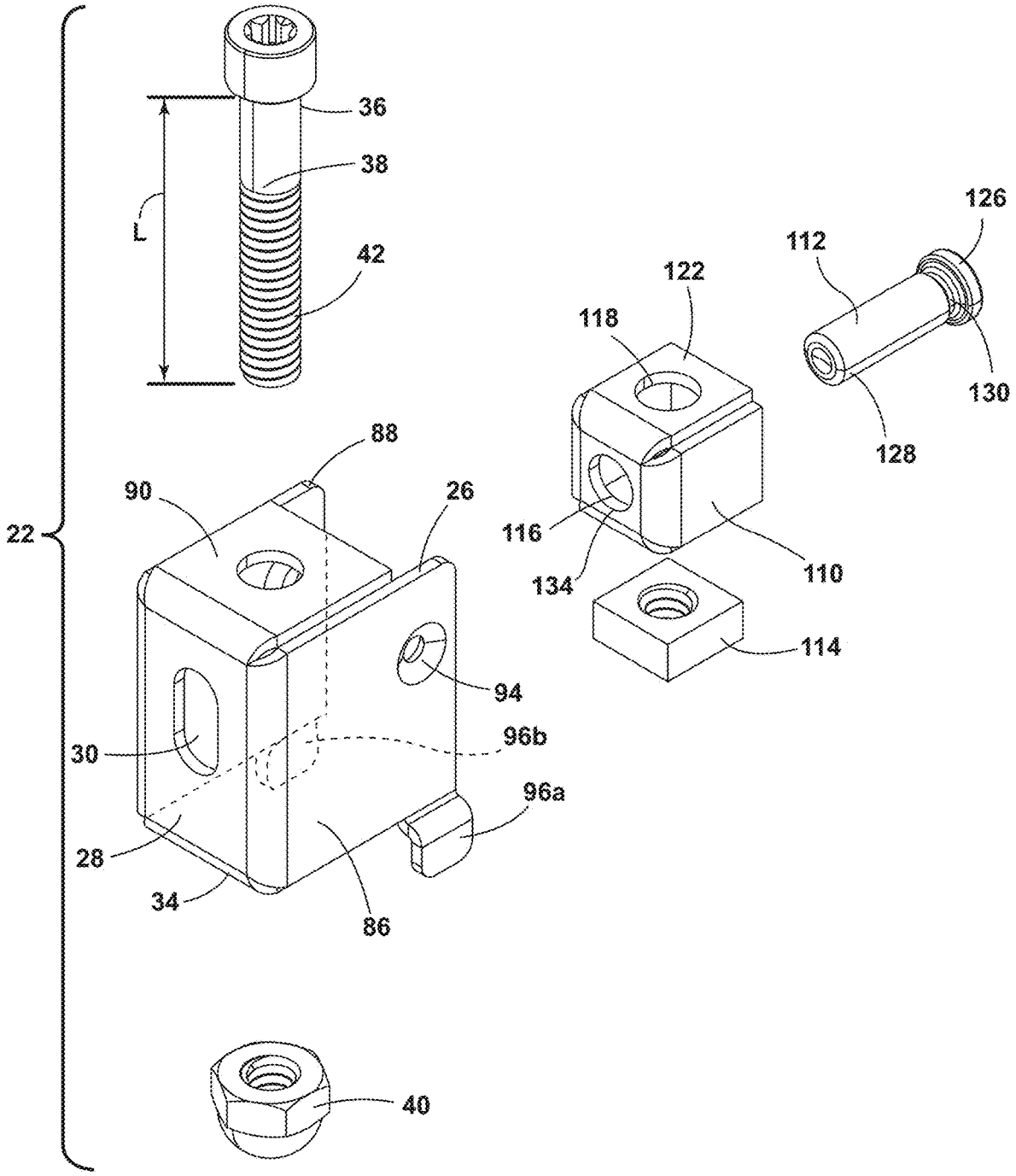
FIG. 5 is an exploded top perspective view of a leveling assembly of the present disclosure with a bracket housing, a leveler, a carrier, and an engagement feature.

With further reference to FIGS. 3 and 5, the at least one leveling assembly 22, can include a first leveling assembly 22*a* and a second leveling assembly 22*b*. In such construction, the first leveling assembly 22*a* is coupled to a first end 80 of the console 18, and the second leveling assembly 22*b* is coupled to a second end 82 of the console 18. As described herein, the first and second leveling assemblies 22*a*, 22*b* generally include the same features, such that the features and construction described herein with relation to the leveling assembly 22 applies to both the first and second leveling assemblies 22*a*, 22*b*. It is also contemplated that the appliance 10 may include a single leveling assembly or more than two leveling assemblies.

As generally mentioned above, the leveling assembly 22 includes at least the bracket housing 26 and the leveler 36. In general, the bracket housing 26 includes at least the first portion 28 and the second portion 32, such that the second portion 32 is normal to the first portion 28 and coupled to the first portion 28 via the arcuate edge 34. The second portion 32 defines a threaded aperture 84 which is configured to receive the threads 42 defined along the shaft 38 of the leveler 36, described in further detail below. As illustrated in FIG. 5, the bracket housing 26 also includes a first sidewall 86, a second sidewall 88, and a top wall 90. While the first portion 28 defines the aperture 30 and the second portion 32 defines the threaded aperture 84, the first and second sidewalls 86, 88 each define a fastening recess 94. Mechanical fasteners may extend through each of the fastening recesses 94 to couple the bracket housing 26 to the frame 12.

A tab 96 extends from the bracket housing 26 and couples the leveling assembly 22 to the frame 12. The tab 96 can be described as arcuate as it generally curves to define a hook attachment with the frame 12, described below. Depicted in FIG. 5, first and second tabs 96*a*, 96*b* extend from the first and second sidewalls 86, 88 respectively, and are configured to couple the bracket housing 26 to the frame 12 of the appliance 10. As illustrated in FIG. 4, the first side 52 of the frame 12 define the slot 58 in which the first tab 96*a* is positioned to at least partially couple the bracket housing 26 to the frame 12. The first sidewall 86 of the bracket housing 26 is generally positioned adjacent the frame 12 so the first tab 96*a* can be positioned within the slot 58 while the first portion 28 of the bracket housing 26 is positioned proximate the flange 70 of the console 18.

Figure 6:
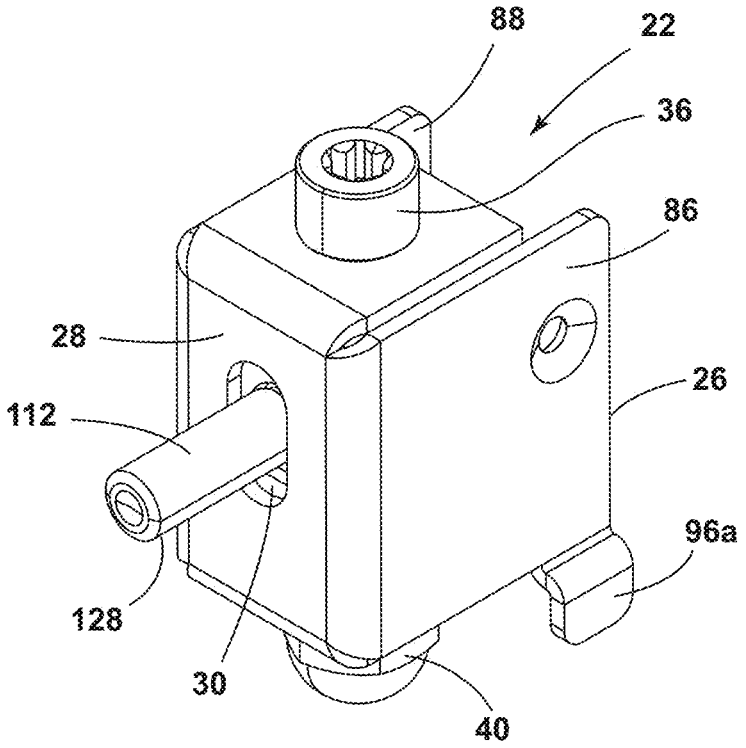
FIG. 6 is a top perspective view of the leveling assembly of FIG. 4.
Figure 7:
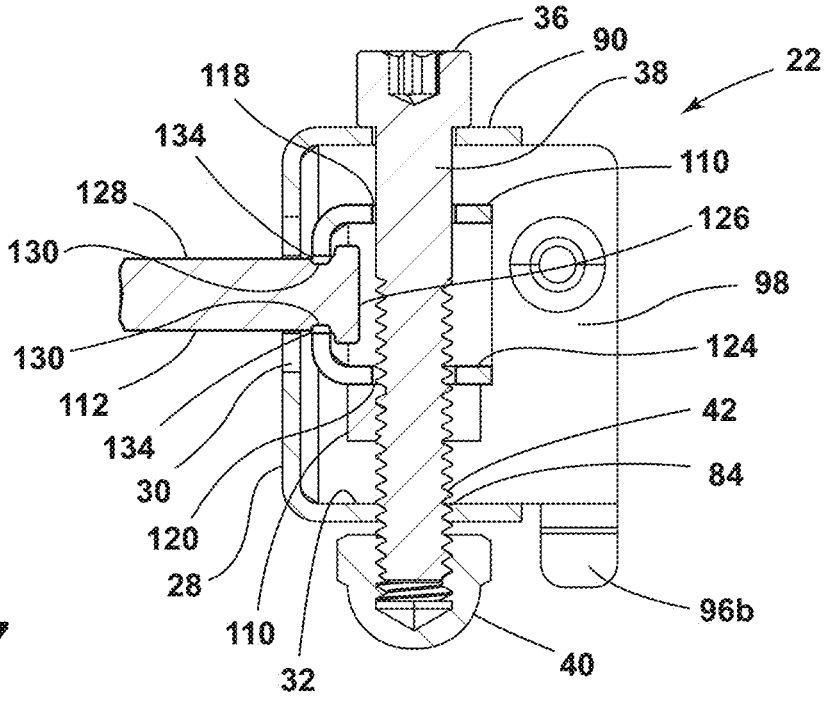
FIG. 7 is a cross-sectional view of the leveling assembly of FIG. 5.

Referring now to FIGS. 5-7, the bracket housing 26 with each of the first portion 28, the second portion 32, the first sidewall 86, the second sidewall 88, and the top wall 90 generally defines a receiving cavity 98. A carrier 110, an engagement feature 112, and a nut 114 of the leveling assembly 22 are disposed within the receiving cavity 98 of the bracket housing 26. The carrier 110, as depicted, has a generally cuboidal shape and defines an opening 116 through which the engagement feature 112, discussed in further detail below, extends. It is generally contemplated, however, that the carrier 110 may take any practicable shape or construction, so long as the engagement feature 112 can extend through the opening 116 defined by the carrier 110. The carrier 110 also defines first and second through-holes 118, 120 defined by a top surface 122 and a bottom surface 124 of the carrier 110, discussed below in relation to the leveler 36.

The engagement feature 112 has an attachment end 126 and an engagement end 128, wherein the attachment end 126 defines a generally circumferential groove 130 around the engagement feature 112. As illustrated in FIG. 5, the attachment end 126 includes a base 132, which is generally larger in diameter relative to the engagement end 128 of the engagement feature 112. The engagement end 128 of the engagement feature 112 extends through the opening 116 defined by the carrier 110, such that the attachment end 126 is configured to receive a perimeter edge 134 of the carrier 110. The perimeter edge 134 of the carrier 110 is received within the groove 130 defined by the attachment end 126 to couple the engagement feature 112 to the carrier 110. In addition, the nut 114 can be positioned beneath the carrier 110 proximate to the bottom surface 124 of the carrier 110, discussed below in relation to the leveler 36.

With further reference to FIGS. 5-7, the leveler 36 is disposed within the bracket housing 26, such that the leveler 36 is coupled to the bracket housing 26 via at least the threaded aperture 84 defined by the second portion 32 of the bracket housing 26. As illustrated in FIG. 7, the leveler 36 extends through the top wall 90 of the bracket housing 26 and the first and second through-holes 118, 120 of the carrier 110. When the leveler 36 is positioned through the bracket housing 26 and the carrier 110, it is generally contemplated that the nut 114 can be rotatably coupled to the leveler 36 and positioned proximate the bottom surface 124 of the carrier 110, as mentioned above. The nut 114 generally provides support for the carrier 110, which is otherwise free from support suspended within the receiving cavity 98 of the bracket housing 26. Additionally or alternatively, the nut 114 may be integrally formed with the carrier 110, such that the second through-hole 120 may define threads to threadably couple the bottom surface 124 of the carrier 110 to the leveler 36 securing the carrier 110 within the receiving cavity 98 of the bracket housing 26.

Referring now to FIGS. 6 and 7, the leveler 36 is threadably coupled to the second portion 32 of the bracket housing 26 by the threads 42 defined along the shaft 38 of the leveler 36. The leveler 36 may be rotatably adjusted relative to the bracket housing 26 and the carrier 110 by rotating the leveler 36. Once rotated and threadably coupled to the bracket housing 26, the leveler 36 may partially extend outwardly from the second portion 32 of the bracket housing 26, such that a portion of the shaft 38 is below the second portion 32 of the bracket housing 26. The knob 40 may then be coupled to the portion of the shaft 38, which is outwardly extending from the bracket housing 26 beneath the second portion 32. The knob 40 as illustrated in FIGS. 5 and 6 is a threaded cap that threadably couples to the shaft 38.

The threaded coupling of the leveler 36 and the bracket housing 26 allows the leveling assembly 22, and thus the console 18 and the front panel 20, to be adjustable within the appliance 10. By way of example, and not limitation, the leveler 36 can be rotated to translate the leveler 36 in either an upward direction or downward direction, such that when the leveler 36 is adjusted upward or downward, the nut 114 and the carrier 110 are also adjusted upward and downward with respect to the bracket housing 26. As the carrier 110 is adjusted upward or downward by the leveler 36, so is the engagement feature 112. The engagement feature 112 is translated within the aperture 30 and engages the flange 70 (FIGS. 3A and 3B) to adjust the console 18 in either the upward or downward direction. This adjustment of the leveler 36, carrier 110, and engagement feature 112 ultimately defines the minimal gap 24 (FIG. 2) between the front panel 20 of the user interface 16 and, at least, the first door 50 of the appliance 10.

Figure 8:
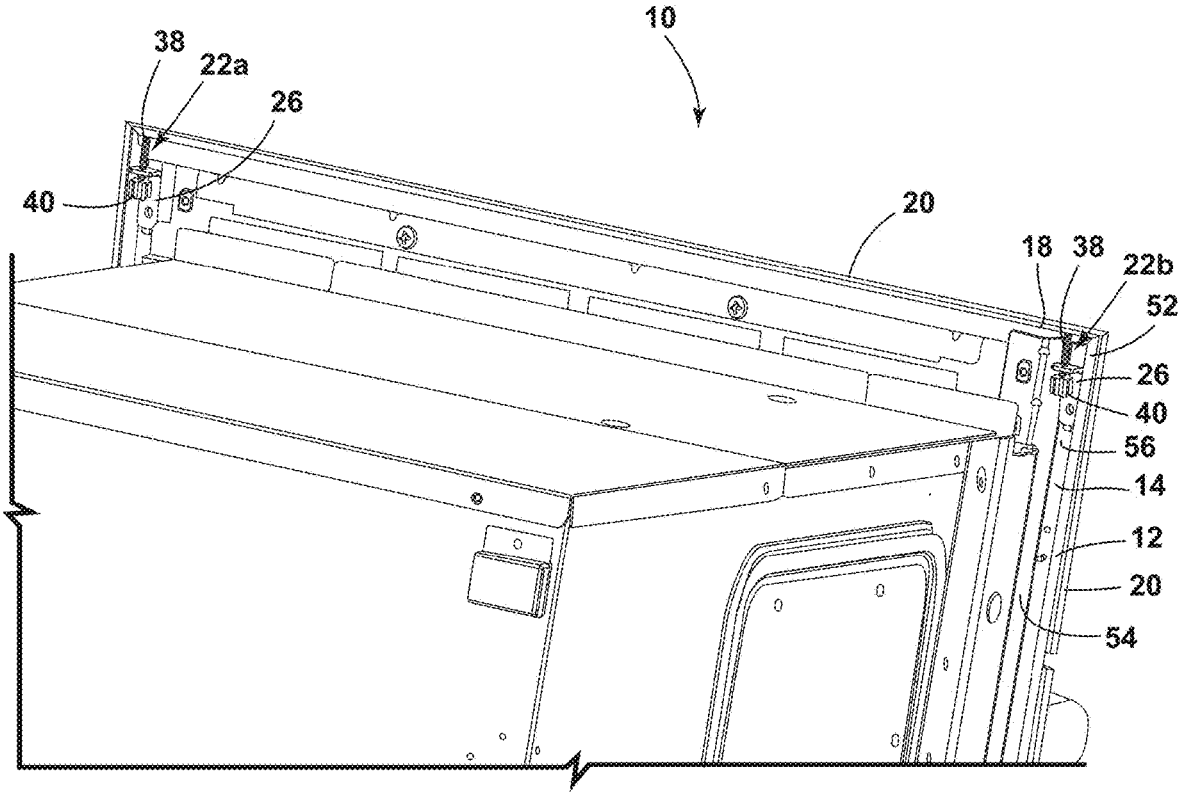
FIG. 8 is a rear perspective view of an appliance of the present disclosure with a leveling assembly in a channel defined by a frame of the appliance.
Figure 9:
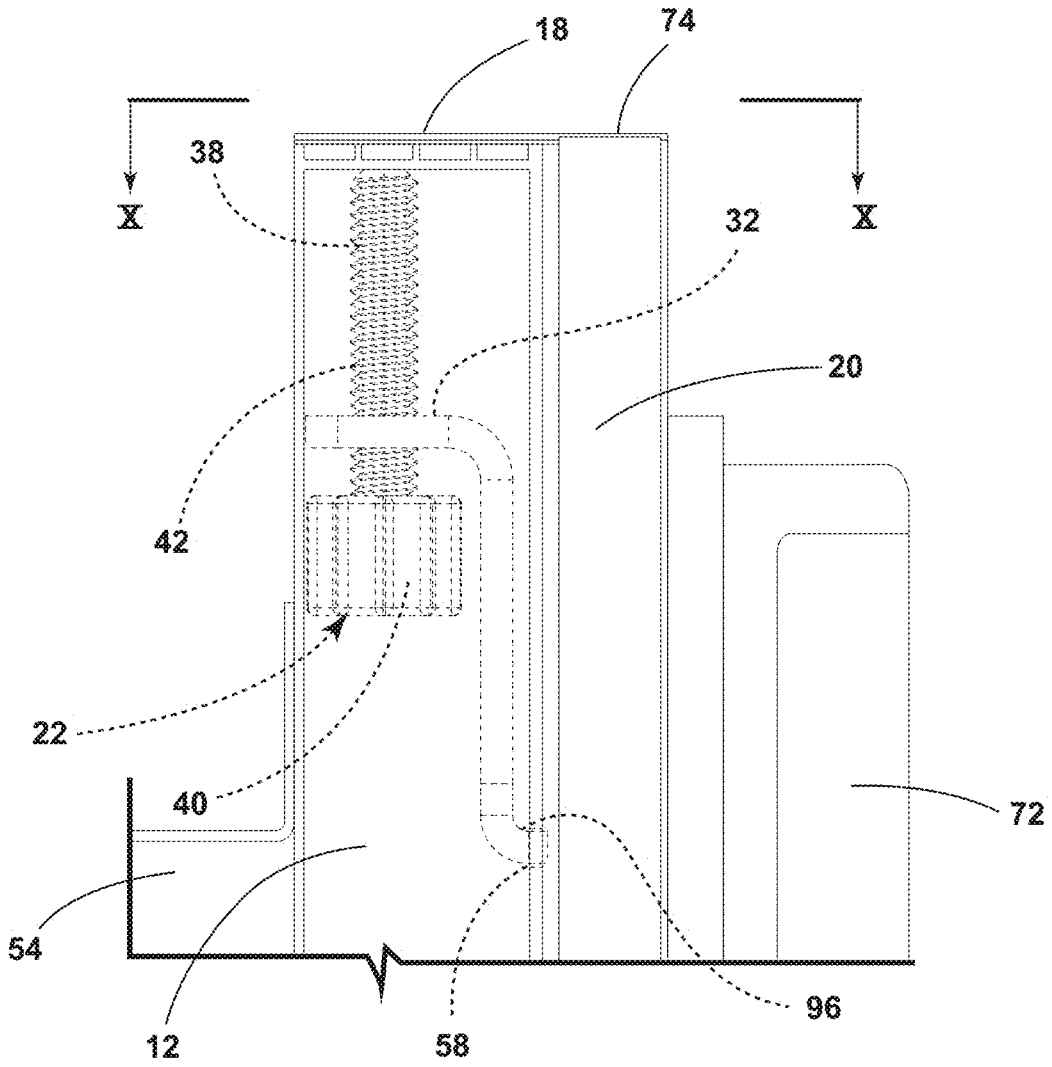
FIG. 9 is an enlarged partial rear perspective view of the leveling assembly of FIG. 8.
Figure 10:
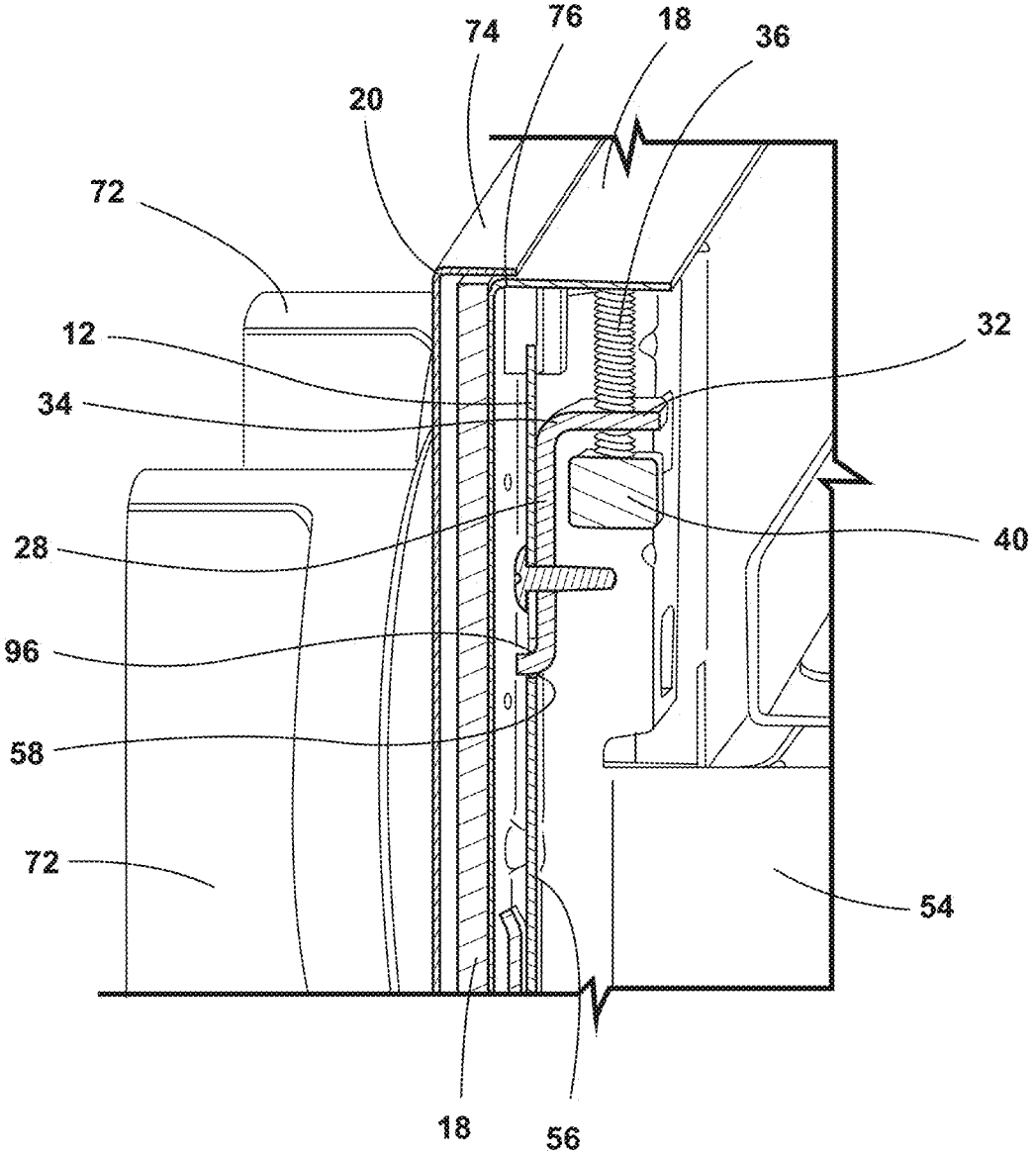
FIG. 10 is a cross-sectional view of the appliance of FIG. 7 taken at line X-X with the leveling assembly coupled to a connecting wall of the frame.
Figure 11:
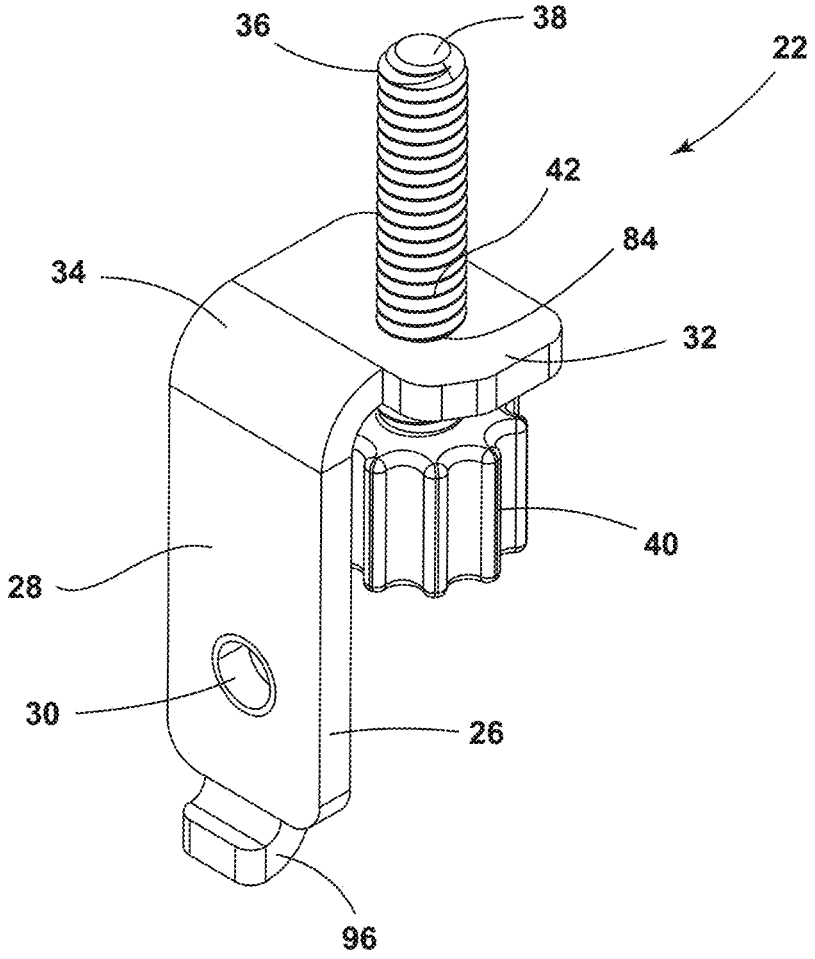
FIG. 11 is a top perspective view of a leveling assembly of the present disclosure.

Referring now to FIGS. 8-10, the leveling assembly 22 is positioned within the channel 14 and coupled to the top edge 76 of the console 18. In this configuration, the bracket housing 26 extends along and is coupled to the connecting wall 56 to retain the leveling assembly 22 within the channel 14 of the frame 12. The first portion 28 of the bracket housing 26 is coupled to the connecting wall 56 of the frame 12 via the tab 96 that extends through the slot 58, which is defined by the connecting wall 56. The second portion 32 of the bracket housing 26 extends away from the connecting wall 56, such that the second portion 32 is generally normal to both the first portion 28 and the connecting wall 56. As mentioned above, the second portion 32 of the bracket housing 26 has the threaded aperture 84 through which the shaft 38 of the leveler 36 extends. In this configuration, the shaft 38 of the leveler 36 extends upwardly from the second portion 32 of the bracket housing 26 to engage the console 18 of the user interface 16, described below.

Figure 12:
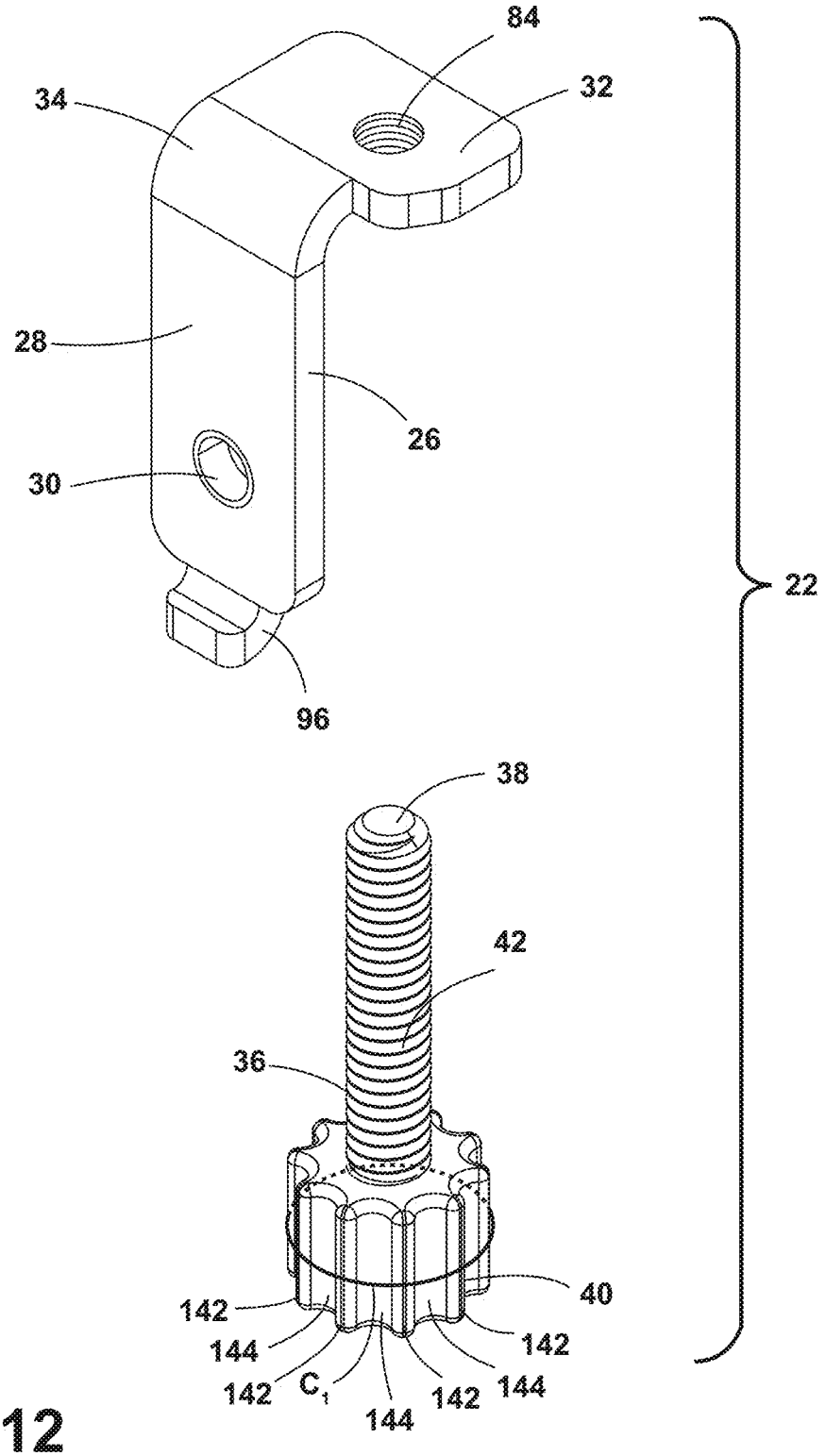
FIG. 12 is an exploded side perspective view of the leveling assembly of FIG. 9.

As mentioned above, the leveler 36 also includes the knob 40 on the portion of the leveler 36 that extends beneath the second portion 32 of the bracket housing 26. The knob 40 defines a series of ridges 142 and recesses 144 around a circumference Ci of the knob 40. The knob 40 is fixedly coupled to the shaft 38 of the leveler 36, such that the knob 40 rotates the shaft 38 while being free from separate rotation relative to the shaft 38. Accordingly, the knob 40 generally rotates the leveler 36 within the bracket housing 26 to translate the shaft 38 through the threaded aperture 84 defined by the second portion 32 of the bracket housing 26. As the shaft 38 translates through the threaded aperture 84, the threads 42 defined along the length L of the shaft 38 threadably engage the threaded aperture 84 of the second portion 32 of the bracket housing 26. As illustrated in FIG. 12, the threads 42 are defined along the entire length L of the shaft 38 for maximum adjustment potential of the leveling assembly 22. The threaded engagement between the second portion 32 of the bracket housing 26 and the leveler 36 retains the leveler 36 at a selected position within the bracket housing 26 and the channel 14.

With further reference to FIGS. 8-12 and as generally mentioned above, the second portion 32 of the bracket housing 26 is coupled to the first portion 28 via the arcuate edge 34. As the leveler 36 is rotated upward to engage the console 18, the second portion 32 of the bracket housing 26 may generally flex or bend, such that the arcuate edge 34 is partially flexible to accommodate tension that may be present between the first portion 28 and the second portion 32 as a result of the coupling between the first portion 28 and the connecting wall 56. This tension may be a result of the rotation of the leveler 36 within the bracket housing 26 to adjust the position of the console 18 and the front panel 20 relative to the first door 50.

Referring again to FIGS. 1-12, the leveling assembly, in any construction described herein, can be used to advantageously and evenly adjust the gap 24 defined between the front panel 20 and the first door 50. The rotation of the leveler 36 sets the distance between the user interface 16 and the first door 50, such that the user interface 16 can be described as floating relative to the first door 50. This floating appearance is achieved by the indirect coupling of user interface 16 to the frame 12 by the leveling assembly 22. The floating user interface 16 can be adjusted upward or downward by the leveling assembly 22 to increase or decrease the gap 24 between the front panel 20 in the first door 50, as described above. Typically, the leveling assembly 22 is adjusted to minimize the gap 24; however, it is also contemplated that the leveling assembly 22 may adjust the front panel 20 and console 18 in an upward direction away from the first door 50 increasing the gap 24. This upward movement of the user interface 16 may be for maintenance purposes or other typical adjustments made with respect to the general use and maintenance of the user interface 16. The incorporation of the leveling assembly 22 allows for such adjustment while easily resetting to retain the overall appearance of the floating user interface 16.

The invention disclosed herein is further summarized in the following paragraphs and is further characterized by combinations of any and all of the various aspects described therein.

According to one aspect of the present disclosure, an appliance includes a frame that defines a channel, and a user interface operably coupled to the frame. The user interface has a console and a front panel. At least one leveling assembly is coupled to the console and is configured to adjust a gap defined between the front panel of the user interface and the frame. The at least one leveling assembly includes a bracket housing that has a first portion that defines an aperture and a second portion that extends orthogonally to the first portion. A leveler has a shaft and a knob that is coupled to the shaft. The leveler extends through a second portion of the bracket housing and defines threads along a length of the shaft.

According to another aspect, at least one leveling assembly is disposed within a channel and is coupled to a frame.

According to yet another aspect, at least one leveling assembly includes a first leveling assembly and a second leveling assembly. The first leveling assembly is operably coupled to a first end of a console and the second leveling assembly is operably coupled to a second end of the console.

According to still another aspect, a carrier is disposed within a bracket housing. The carrier defines an opening proximate to an aperture defined by the bracket housing. An engagement feature is coupled to the carrier and extends outwardly from the opening and through the aperture defined by a first portion of the bracket housing.

According to another aspect, a leveler is operably coupled to a carrier and is configured to translate the carrier and an engagement feature within a bracket housing and an aperture.

According to another aspect, a first portion of a bracket housing includes a tab that is configured to engage a frame.

According to yet another aspect, a second portion of a bracket housing defines a threaded aperture. A shaft of a leveler is rotatably coupled to the second portion via the threaded aperture.

According to still another aspect, an engagement feature defines a groove. A perimeter edge of a carrier is disposed within the groove and operably couples the engagement feature to a carrier.

According to another aspect of the present disclosure, a leveling assembly for a user interface includes a bracket housing that defines an aperture. A tab projects from the bracket housing. The tab is configured to engage a frame of an appliance. A carrier is disposed within the bracket housing. The carrier defines an opening proximate to the aperture defined by the bracket housing. An engagement feature is coupled to the carrier and extends through the opening and the aperture. A leveler is operably coupled to the carrier and is configured to translate the carrier between a first position and a second position relative to the aperture defined by the bracket housing.

According to another aspect, an engagement feature is configured to engage a console frame of a user interface to minimize a gap that is defined by the user interface.

According to yet another aspect, an engagement feature defines a groove and an opening of a carrier that is defined by a perimeter edge.

According to still another aspect, a perimeter edge of a carrier is disposed within a groove of an engagement feature.

According to another aspect, a nut is operably coupled to a leveler proximate to a carrier. The nut engages the carrier.

According to still another aspect, a leveler extends through a bracket housing and includes a shaft having threads defined along a length thereof.

According to yet another aspect, a bracket housing defines a threaded aperture. Threads of a shaft are rotatably coupled to the bracket housing via the threaded aperture.

According to another aspect, a leveler is operably coupled to a carrier and is configured to translate the carrier between a first position and a second position relative to a threaded aperture defined by a bracket housing.

According to yet another aspect of the present disclosure, an appliance includes a frame that defines a channel and a slot. A leveling assembly is coupled to the frame and includes a bracket housing that has a tab, a first portion and a second portion normal relative to the first portion. The second portion defines a threaded aperture. A leveler has a shaft that defines threads along a length of the shaft, and a knob is coupled to the shaft. The shaft extends through the threaded aperture defined by the second portion of the bracket housing and rotatably couples the leveler to the bracket housing. A user interface has a front panel and a console that is operably coupled to the frame via the leveling assembly.

According to another aspect, a tab is disposed within a slot defined by a frame and is configured to couple a bracket housing to the frame.

According to still another aspect, a leveling assembly is configured to adjust a gap defined between a front panel of a user interface and a frame.

According to another aspect, a bracket housing includes an arcuate edge. A first portion of the bracket housing is coupled to a second portion of the bracket housing via the arcuate edge.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance, comprising:
- a frame defining a channel;
- a user interface having a console and a front panel, the user interface operably coupled to the frame; and
- at least one leveling assembly coupled to the console and configured to adjust a gap defined between the front panel of the user interface and the frame, the at least one leveling assembly comprising:
  - a bracket housing having a first portion that defines an aperture and a second portion extending orthogonally from the first portion; and
  - a leveler that has a shaft and a knob coupled to the shaft, the leveler extending through the second portion of the bracket housing and defining threads along a length of the shaft.

2. The appliance of claim 1, wherein the at least one leveling assembly is disposed within the channel and coupled to the frame.

3. The appliance of claim 1, wherein the at least one leveling assembly includes a first leveling assembly and a second leveling assembly, the first leveling assembly operably coupled to a first end of the console and the second leveling assembly operably coupled to a second end of the console.

4. The appliance of claim 1, wherein the leveling assembly further comprises:
- a carrier disposed within the bracket housing, the carrier defining an opening proximate to the aperture defined by the bracket housing; and
- an engagement feature coupled to the carrier and extending outwardly from the opening and through the aperture defined by the first portion of the bracket housing.

5. The appliance of claim 4, wherein the leveler is operably coupled to the carrier and is configured to translate the carrier and the engagement feature within the bracket housing and the aperture, respectively.

6. The appliance of claim 1, wherein the first portion of the bracket housing includes a tab configured to engage the frame.

7. The appliance of claim 1, wherein the second portion of the bracket housing defines a threaded aperture, and wherein the shaft of the leveler is rotatably coupled to the second portion via the threaded aperture.

8. The appliance of claim 4, wherein the engagement feature defines a groove, and wherein a perimeter edge of the carrier is disposed within the groove and operably couples the engagement feature to the carrier.

9. A leveling assembly for a user interface, comprising:
- a bracket housing that defines an aperture;
- a tab projecting from the bracket housing, the tab being configured to engage a frame of an appliance;
- a carrier disposed within the bracket housing, the carrier defining an opening proximate to the aperture defined by the bracket housing;
- an engagement feature coupled to the carrier and extending through the opening and the aperture; and
- a leveler operably coupled to the carrier and configured to translate the carrier between a first position and a second position relative to the aperture defined by the bracket housing.

10. The leveling assembly of claim 9, wherein the engagement feature is configured to engage a console frame of said user interface to minimize a gap defined by said user interface.

11. The leveling assembly of claim 9, wherein the engagement feature defines a groove and the opening of the carrier is defined by a perimeter edge.

12. The leveling assembly of claim 11, wherein the perimeter edge of the carrier is disposed within the groove of the engagement feature.

13. The leveling assembly of claim 9, further comprising:
- a nut operably coupled to the leveler proximate to the carrier, the nut engaging the carrier.

14. The leveling assembly of claim 9, wherein the leveler extends through the bracket housing and includes a shaft having threads defined along a length thereof.

15. The leveling assembly of claim 14, wherein the bracket housing defines a threaded aperture, and wherein the threads of the shaft are rotatably coupled to the bracket housing via the threaded aperture.

16. The leveling assembly of claim 9, wherein the leveler is operably coupled to the carrier and configured to translate the carrier between the first position and the second position relative to the threaded aperture defined by the bracket housing.

17. An appliance, comprising:
- a frame defining a channel and a slot;
- a leveling assembly coupled to the frame, the leveling assembly comprising:
  - a bracket housing having a tab, a first portion, and a second portion normal relative to the first portion, the second portion defining a threaded aperture; and
  - a leveler having a shaft that defines threads along a length of the shaft and a knob coupled to the shaft, the shaft extending through the threaded aperture defined by the second portion of the bracket housing and rotatably coupling the leveler to the bracket housing; and
- a user interface having a front panel and a console operably coupled to the leveling assembly, the user interface operably coupled to the frame via the leveling assembly.

18. The appliance of claim 17, wherein the tab is disposed within the slot defined by the frame and is configured to couple the bracket housing to the frame.

19. The appliance of claim 17, wherein the leveling assembly configured to adjust a gap defined between the front panel of the user interface and the frame.

20. The appliance of claim 17, wherein the bracket housing includes an arcuate edge, and wherein the first portion of the bracket housing is coupled to the second portion of the bracket housing via the arcuate edge.

* * * * *